United States Patent [19]

Bragin et al.

[11] Patent Number: 5,040,674

[45] Date of Patent: Aug. 20, 1991

[54] CIGARETTE PACK DISPLAY CONTAINER

[75] Inventors: David G. Bragin, Brooklyn; Frederick M. DellaCrosse, White Plains, both of N.Y.

[73] Assignee: Philip Morris Incorporated, New York, N.Y.

[21] Appl. No.: 622,820

[22] Filed: Dec. 5, 1990

[51] Int. Cl.[5] ..... A24F 15/00; B65D 85/10; B65D 5/52; A47F 3/14

[52] U.S. Cl. ..... 206/242; 206/44 R; 206/45.34; 206/265; 206/256; 211/194; 211/126

[58] Field of Search ..... 206/44 R, 45.34, 45, 206/45.11, 270, 265, 459, 256, 248, 242; 211/71, 194, 131, 126

[56] References Cited

U.S. PATENT DOCUMENTS

| | | | |
|---|---|---|---|
| D. 83,130 | 1/1931 | Scholes | D35/2 |
| D. 164,068 | 7/1951 | Soffe | D35/2 |
| D. 164,069 | 7/1951 | Soffe | D35/2 |
| D. 298,412 | 12/1988 | Ciuba | D9/430 |
| 1,924,823 | 8/1933 | Willi | 229/120.23 |
| 2,080,818 | 5/1937 | Hackman | 211/71 |
| 2,106,301 | 1/1938 | Hughes | 206/44 R |
| 2,237,126 | 4/1941 | Weinman | 206/44 |
| 2,435,698 | 2/1948 | Running | 211/49 |
| 3,314,531 | 4/1967 | Cheris et al. | 206/44 R |
| 3,941,247 | 3/1976 | Cripe | 206/511 |
| 4,374,560 | 2/1983 | Howlett | 206/44 R |
| 4,386,729 | 6/1983 | Schmidt | 229/39 R |
| 4,418,862 | 12/1983 | Vesborg | 229/41 C |
| 4,752,007 | 6/1988 | Rossi et al. | 206/444 |
| 4,947,993 | 8/1990 | Bruml et al. | 206/45.34 |

*Primary Examiner*—Paul T. Sewell
*Assistant Examiner*—M. Denise Patterson
*Attorney, Agent, or Firm*—Charles B. Smith

[57] ABSTRACT

A cigarette pack display container is disclosed. The container includes a cover member and a base member which are connected about a rim. The cover member has outwardly extending pockets. Between the pockets is a corner wall including a polygonal panel portion and a trapezoidal panel portion. The base member includes pockets and triangular facets spaced between the pockets. Between the rim below the triangular facet and the rim below the trapezoidal panel portion is an engaging element for reinforcing the cover member to the base member. The reinforcement means includes a lip of the cover member that overlaps and inserts beneath the bead of the base member. A receiving element also may be provided for holding complementary articles. In addition, the cover member may have a slightly recessed top wall for receiving a label for identifying the display.

10 Claims, 9 Drawing Sheets

FIG. 6
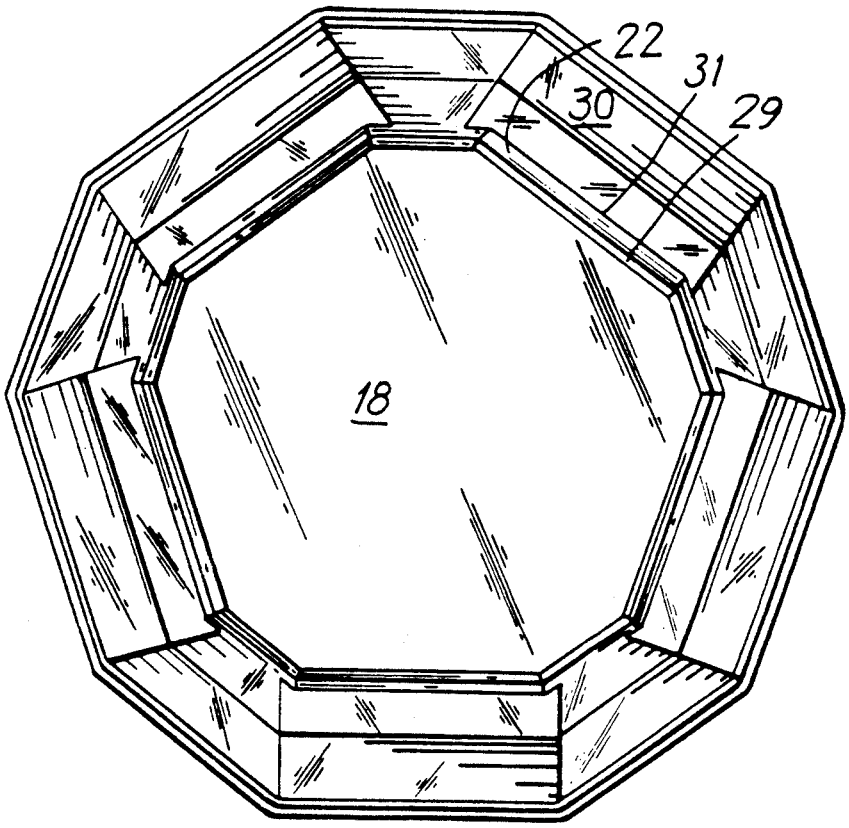
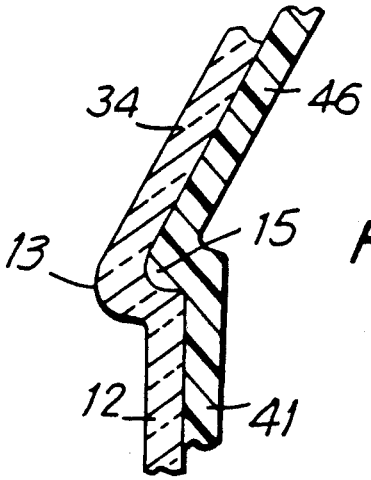
FIG. 13

FIG. 8
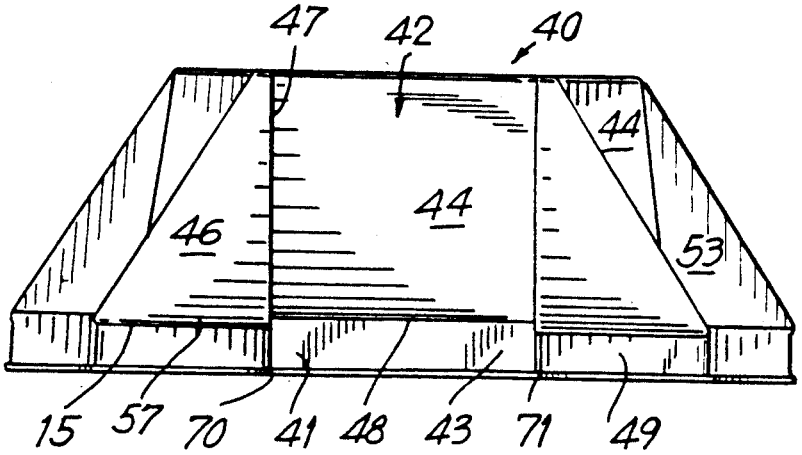
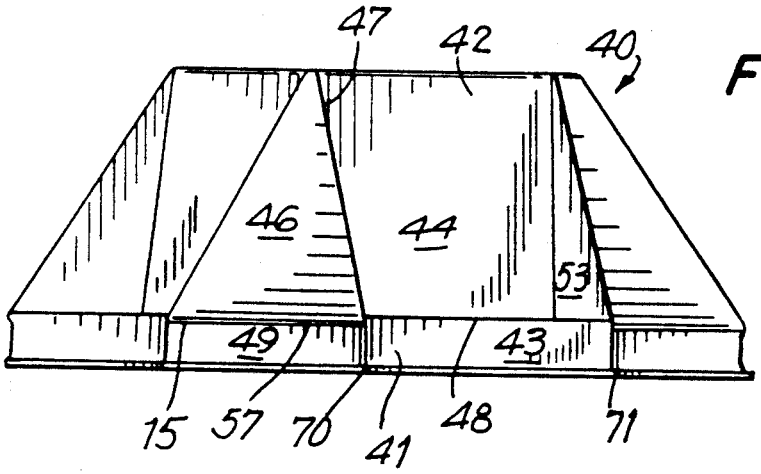
FIG. 9
FIG. 10
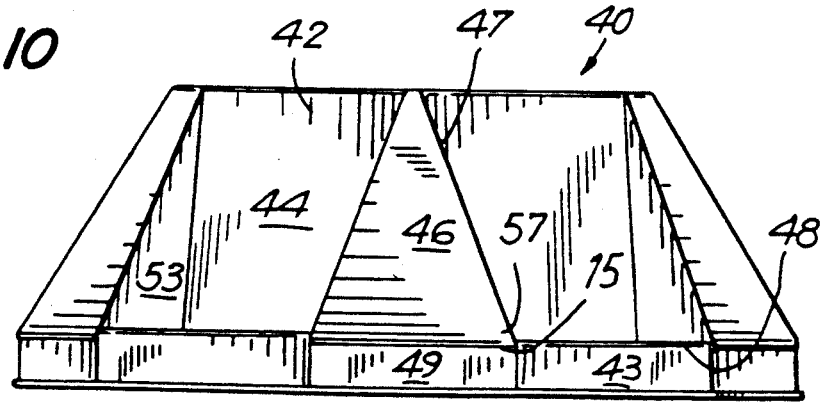

FIG. 11
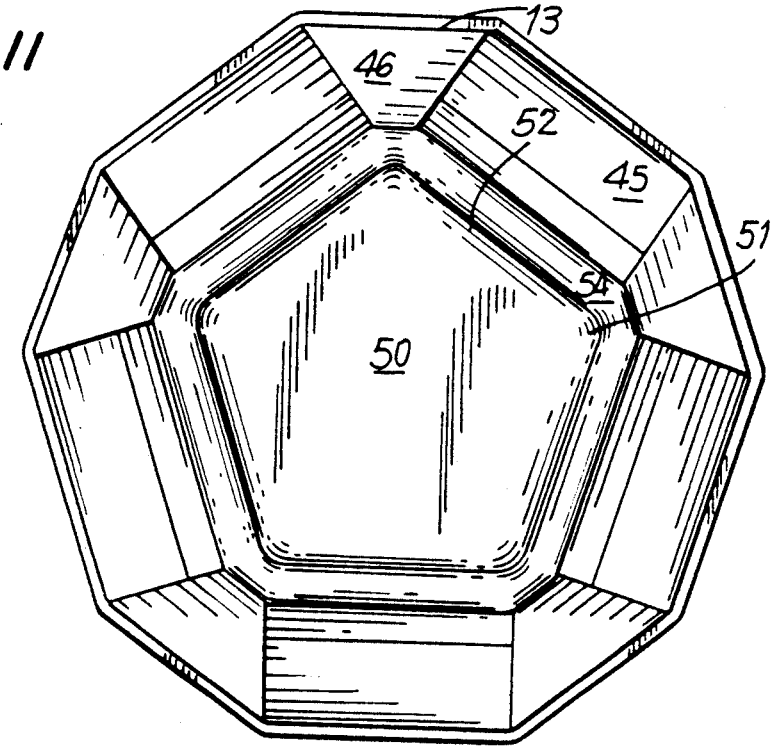
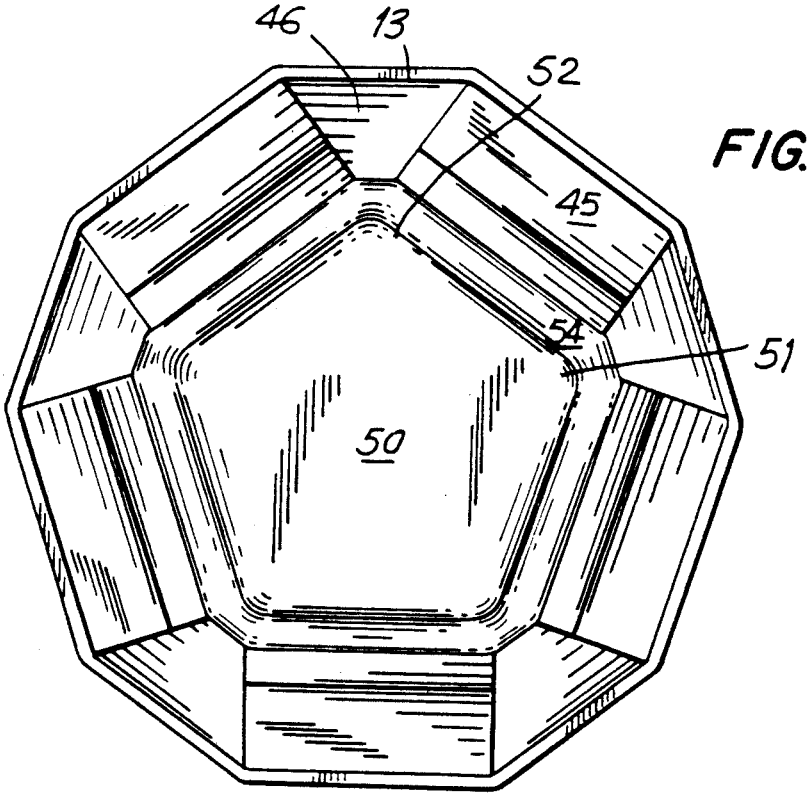
FIG. 14

FIG. 15
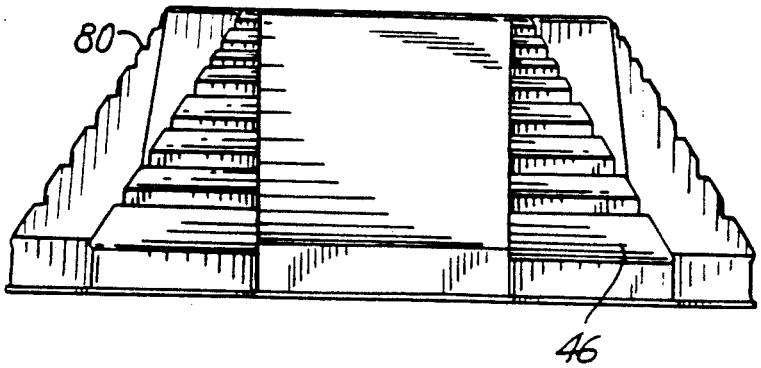
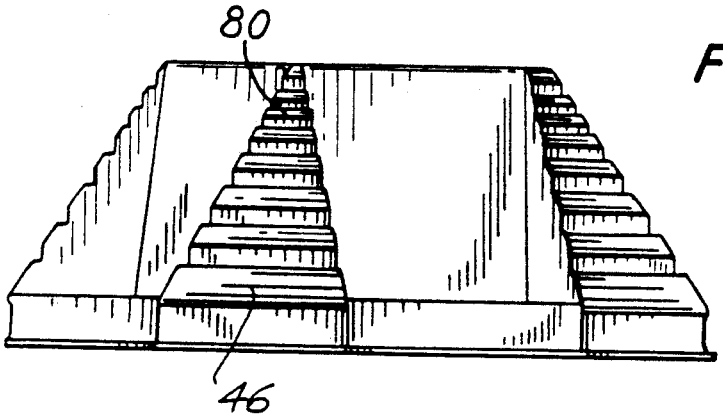
FIG. 16
FIG. 17
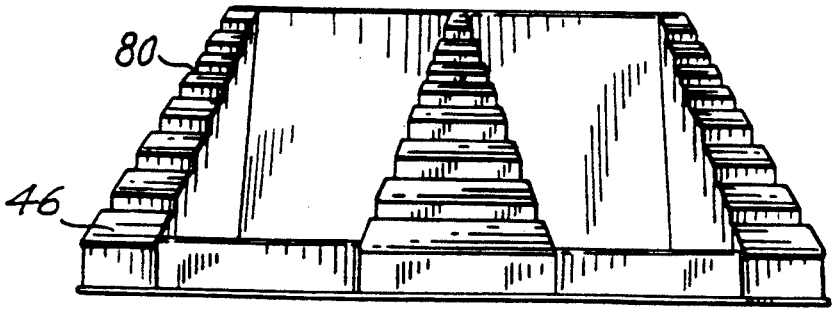

FIG. 18
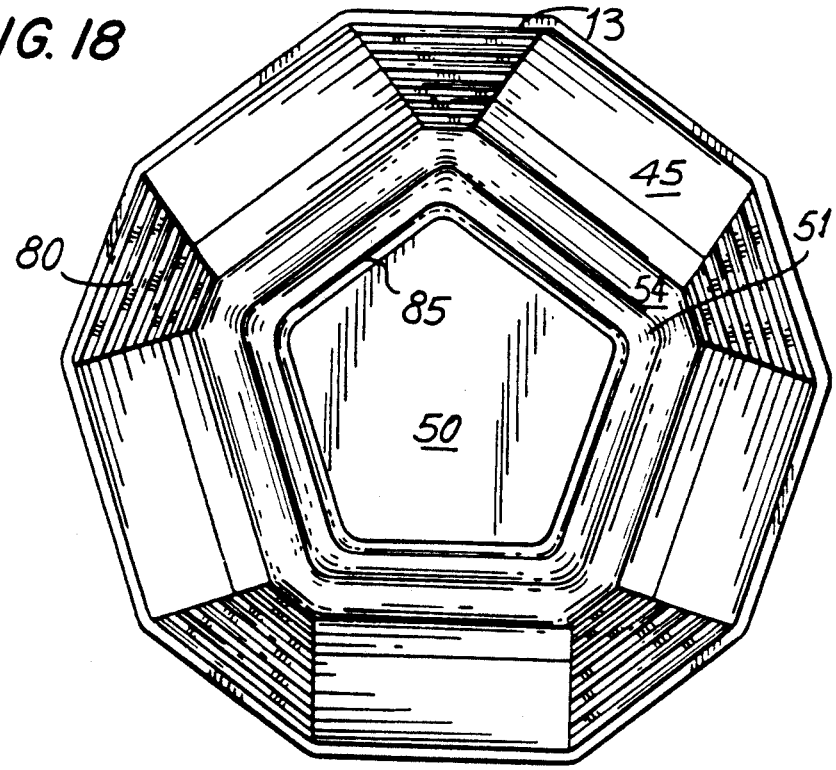
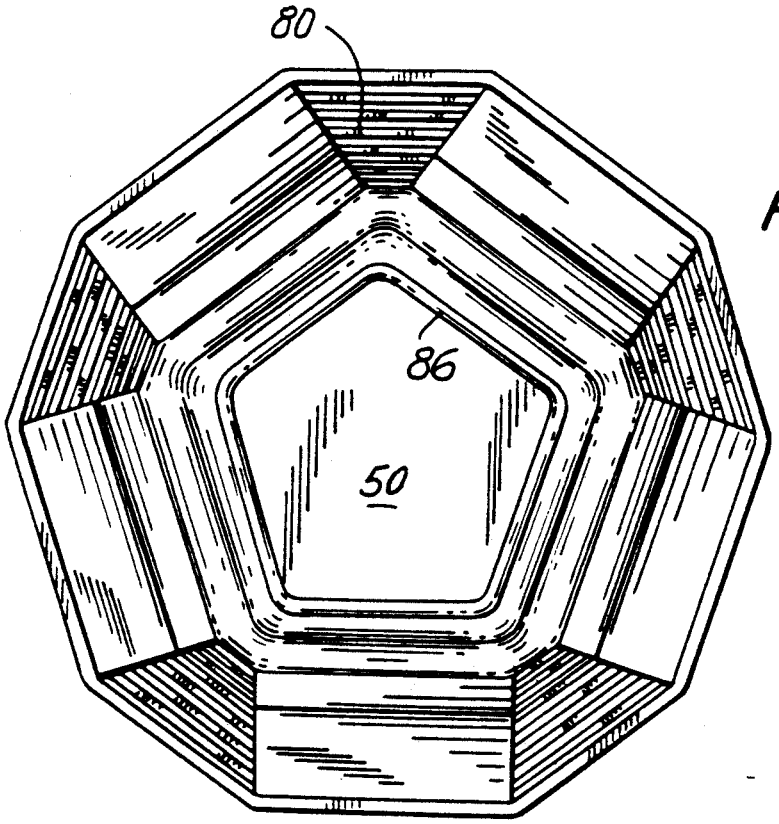
FIG. 19

CIGARETTE PACK DISPLAY CONTAINER

BACKGROUND OF THE INVENTION

This invention relates to a display container for cigarette packs. Display containers are commonly used to display a variety of cigarette packs. When the containers are stacked users commonly desire to remove the top most container. Heretofore, such a conventional stack of display containers became disrupted when a container unit was removed. In other prior instances, the members used were usually engaged too tightly and were difficult to open.

Conventional cigarette packs have different heights. Therefore, a prior typical display case containing these packs appeared asymmetrical and thus unpleasant aesthetically.

It would be advantageous to provide a cigarette display container that will prevent slippage of other containers in a stack when a top container is removed. Still further it would be advantageous to provide a cigarette display container that is easy to open to remove the cigarette packs. It would be further advantageous to permit cigarette packs of different heights to be displayed without lack of symmetry.

SUMMARY OF THE INVENTION

It is an object of the present invention to provide a container of the type described above which stacks in the same manner as conventional container but can also be removed from the top of the stack without disrupting the stack.

It is another object of the invention to provide stackable containers in which a base of an upper container shields from view the interlocking element from a lower container.

It is a further object of the invention to effect an easy removal of the members of the container.

It is still another object of the invention to provide stackable containers in which the container when stacked shields from view any extra space in a lower container that may result from different heights of cigarette packs.

A cigarette pack display container according to the invention includes a cover member and base member. The cover member is dimensioned to fit over the base member so that an inward facing surface of the rim of the cover member is adjacent to an outward facing surface of the rim of the base member in the engaged position. The cover comprises a plurality of main sides, each identical to the other and including a rectangular protruding pocket having a respective length in a direction perpendicular to the rim line. The rectangular pocket includes an outward facing front wall connected to side walls and a ceiling panel. The base of the front wall abuts the rim. The inward edge of the side panel is connected to a corner wall panel spacing the pockets apart. The base portion of the wall is connected to the rim. The corner wall extends from the rim to form a trapezoidal panel portion which is connected to polygonal panel portion, the upper portion providing a panel to form a platform at the top of the cover member. The platform of the cover member may also include a recessed top wall defined therein, so that the container may hold desirable merchandise labels. The base member similarly comprises a plurality of major sides, each side including a pocket having a bottom wall connected to side walls and connected to a rear wall parallel to the pocket front wall of the cover. The portion of the base member defining the rim panel is connected to the pocket bottom wall panel at the outward facing edge. The outward edge of the pocket side wall is connected to the edge of a triangular facet spaced between the pocket side walls. Adjacent to the base portion of the triangular facet is the rim. The cover member is dimensioned to fit over the base member so that the engagement is reinforced at the lower edge of the triangular facet. The base member may include a recessed top wall. The container further comprises a stacking means at the top of the cover member and underneath the base member for interlocking the containers for display. The stacking means includes a platform at the top portion of the cover member. When the base member is stacked onto the cover member, the platform will be inserted next to the inward facing surface of the pocket rear wall of base member until the base member rests on the ceiling panel of the pocket, resulting in an interlocking effect to prevent slippage, thus allowing stacking.

BRIEF DESCRIPTION OF THE DRAWINGS

The above and other objects and advantages of the invention will be apparent after consideration of the following detailed description, taken in conjunction with the accompanying drawings, in which like reference characters represent like parts throughout, and in which:

FIG. 6 is a top plan view of the cover member of the container of FIG. 1;

FIG. 8 is a side elevational view of the base member of the container of FIG. 1 from a first angular perspective;

FIG. 9 is a side elevational view of the base member of the container of FIG. I from a second angular perspective;

FIG. 10 is a side elevational view of the base member of the container of FIG. 1 from a third angular perspective;

FIG. 11 is a top plan view of the base member of the container of FIG. 1;

FIG. 13 is a fragmentary enlarged sectional view of the area shown by the arrow A of FIG. 12; and FIG. 14 is a bottom plan view of the base member of the container of FIG. 1.

FIG. 15 is a side elevational view of an alternate embodiment of the base member of the container of FIG. I from a first angular prospective.

FIG. 16 is a side elevational view of an alternate embodiment of the base member of the container of FIG. 1 from a second angular perspective.

FIG. 17 is a side elevational view of an alternate embodiment of the base member of the container of FIG. 1 from a third angular perspective.

FIG. 18 is a top plan view of an alternate FIG. 1.

FIG. 19 is a bottom plan view of an alternate embodiment of the base member of the container of FIG. 1.

DETAILED DESCRIPTION OF THE INVENTION

Figure 1:
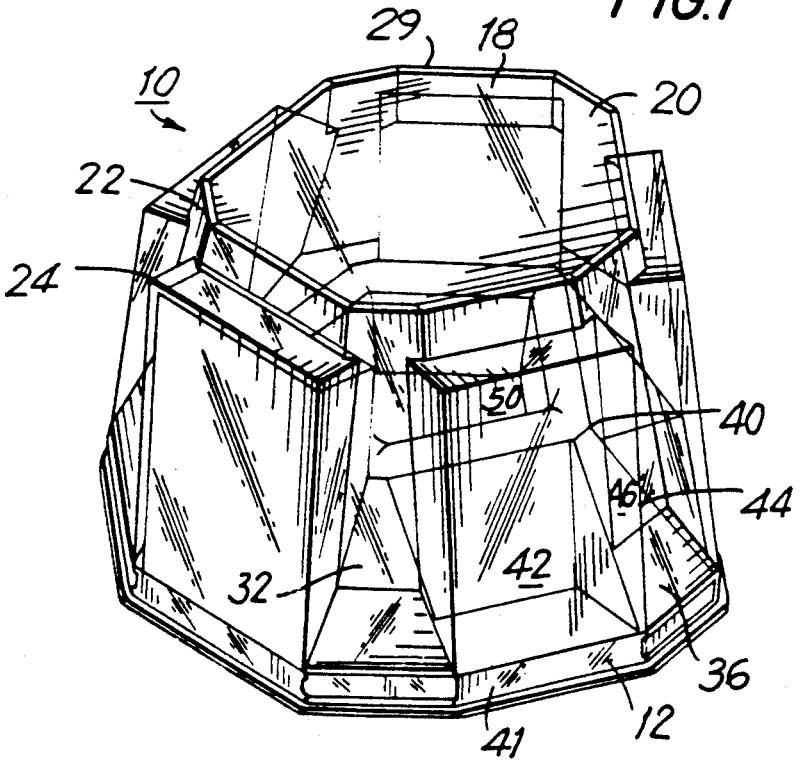
FIG. 1 is a perspective view of a container according to the invention.
Figure 2:
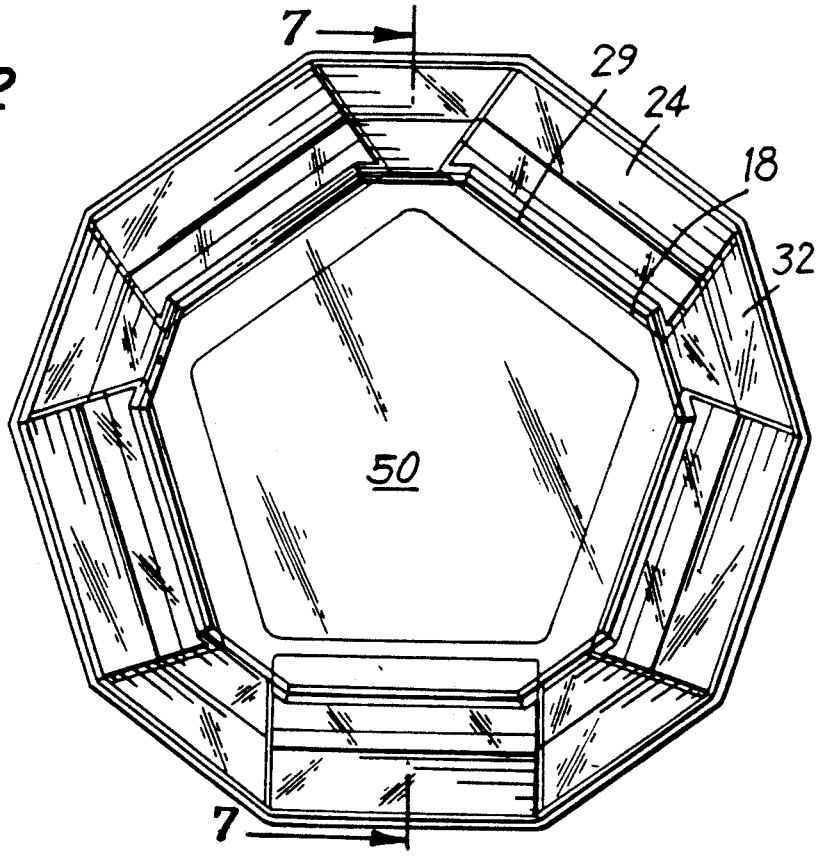
FIG. 2 is a top plan view of the container of FIG. 1.
Figure 3:
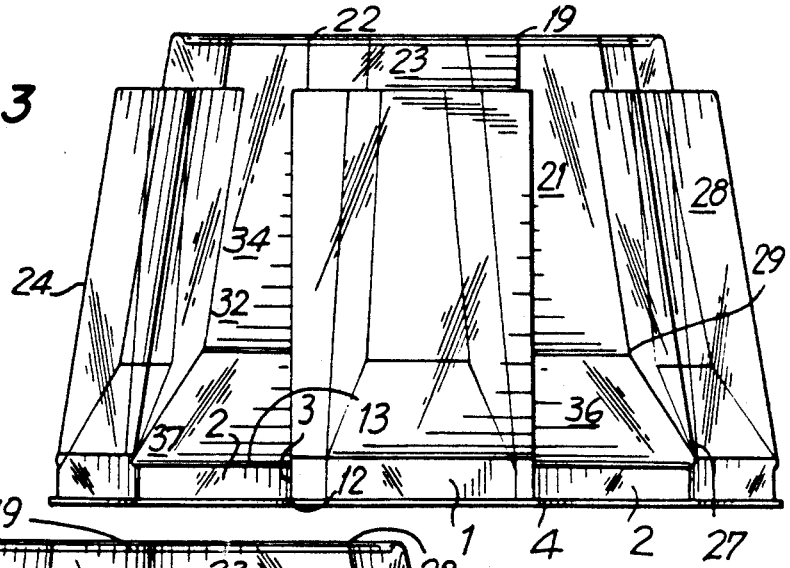
FIG. 3 is a side elevational view of the cover member of the container of FIG. 1 from a first angular position.
Figure 4:
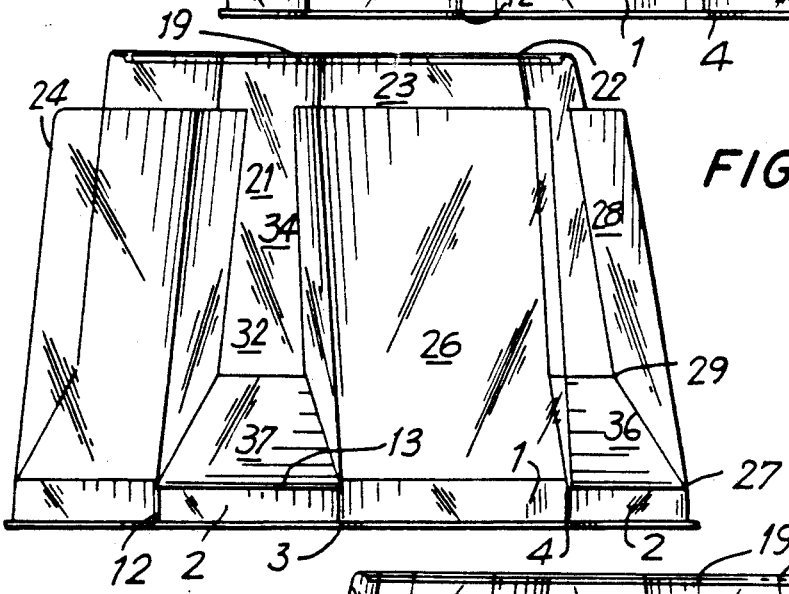
FIG. 4 is a side elevational view of the cover member of the container of FIG. 1 from a second angular position.
Figure 5:
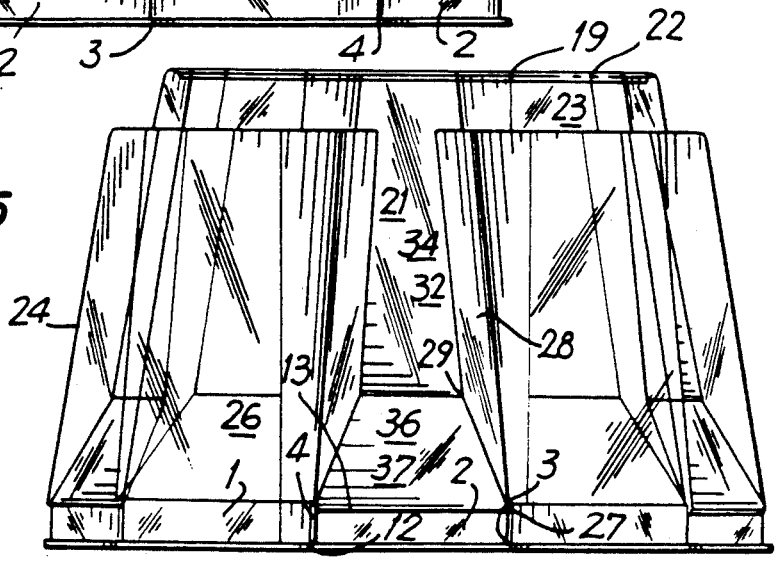
FIG. 5 is a side elevational view of the cover member of the container of FIG. 1 from a third angular position.

FIGS. 1 and 2 show a container 10 according to a first embodiment of the invention. As shown in FIG. 1, the cover member 20 of container 10 extends over the base member 40 engaging at rim 12. Cover member 10 includes a platform 22, rectangular pockets 24 between which extend corner wall panels 32, and a top wall 18 recessed below the top edge 29 of platform 22. Base member 40 includes pockets 42, which extend between substantially triangular facets 46. As shown, there are five pockets 42 in the preferred embodiment; however, any number of pockets may be provided. Base member 40 also includes a recessed top wall 50.

Figure 7:
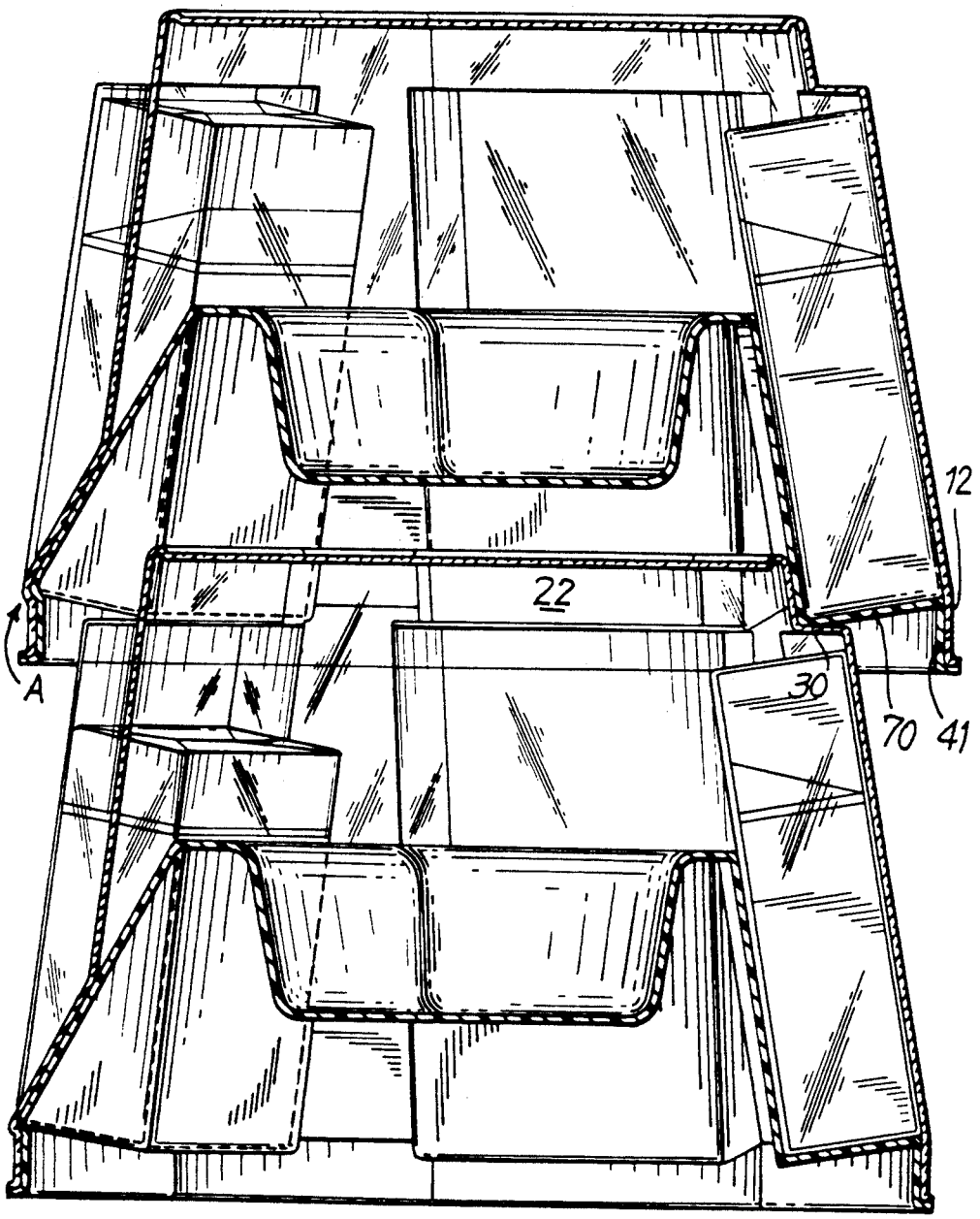
FIG. 7 is a cross-sectional view of a container of FIG. 1 arranged in a vertical stack of two containers, the top container holding 2 cigarette packs of different heights taken along line 7—7 of FIG. 2.

The cover member 20 shown in FIGS. 3-6 includes corner wall panels 32, rectangular pockets 24, rim 12 and platform 22. Extending downward from corner wall panel is panel 2. Similarly, extending downward from rectangular pocket 24 is panel 1. Panel 1 and panel 2 connect at edges 3 and 4 to form rim 12 around the bottom of the cover member. Corner wall panel 32 is slightly recessed inwardly of the lower rim 12 and is formed by a polygonal panel portion 34 and a trapezoidal panel portion 36 flaring outwardly therefrom to the upper edge 14 of panel 2. Rectangular pocket 24 positioned between corner wall panels 32 extends upwards from upper edge 13 of panel 1 of rim 12, and comprises front wall 26, side walls 28 and ceiling panel 30. Ceiling panel 30 includes inner edge 31 which is connected to platform 22. The outward edge 27 of pocket side wall 28 extends below the inward edge 29 of pocket side wall 28, so that the trapezoidal panel portion 36 conforms to a portion of triangular facet 46 of base member 40 when the cover member 20 and base member 40 are engaged. Extending from inner edge 31 of pocket ceiling panel 30 is upper panel 23 which is connected to the upper portion 21 of polygonal panel portion 32 of corner wall panel 32 at edge 19, resulting in the formation of platform 22, which, when two containers 10 are stacked as shown in FIG. 7, serves as a extension for interlocking the containers 10. As shown in FIGS. 1 and 6, in the preferred embodiment platform 22 has top wall 18 recessed below the plane of edge 29 of platform 22 by a distance from edge 29 which may be approximately one-eighth of the height of platform 22, for the reception of a display label.

Figure 12:
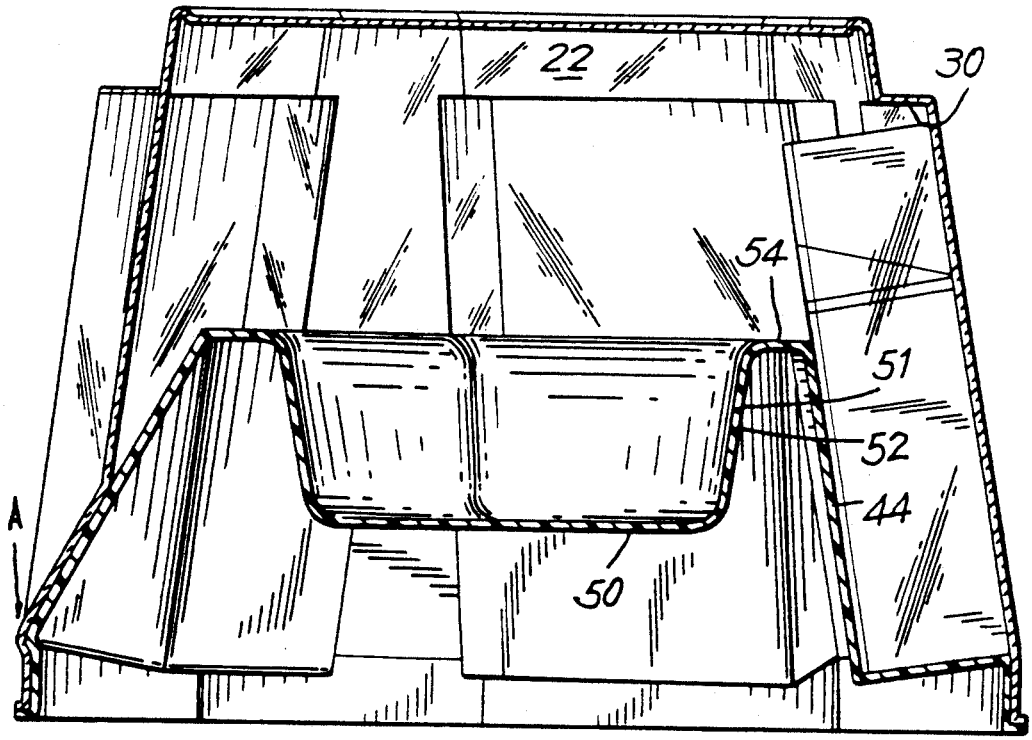
FIG. 12 is a cross-sectional view of a container of FIG. 1, taken along line 3—3 of FIG. 2.

FIGS. 8-11 illustrate base member 40 including a plurality, preferably five, of rectangular pockets 42 having side walls 53 connected together by means of rear wall 44 and bottom wall 45 which can be more clearly seen in FIG. 1. Cigarette packs may be arranged substantially upright in pocket 42, supported in pocket 42 by side walls 53 and rear wall 44. Outward edge 47 of side wall 53 abuts triangular facet 46 which is flat and spaced between pockets 42. In another embodiment of the present invention, as shown in FIG. 15-17, the triangular facet 46 is provided with rows of substantially parallel grooves 80 therein extending laterally from one side of the triangular facet 46 to the other side to provide structural strength to the container. Extending downward from the outward edge 48 of pocket 42 is panel 43. Similarly, extending downward from triangular facet 46 is panel 49. Panel 43 and panel 49 connect at edges 70 and 71 to form rim 41 around the bottom of the base member 40. FIGS. 11 and 12 show in a preferred embodiment top wall 50 recessed below the plane of the top edge 54 of pocket rear wall 44. The recessed top wall 50 provided by recess wall 52 provides a pocket 51 for receiving complementary articles, such as display premiums, about the top portion of the base member 40 of the container 10 in a configuration of a relatively deep walled inverted channel section defined by recessed wall 52 and top edge 54. As can be seen in FIG. 18 recessed top wall 50 of pocket 51 may include ring 85 extending below top wall 50 and is generally of polygonal shape. Underside surface 86 of ring 85 is shown in FIG. 14. Ring 85 is so positioned in base member 40 as to conceal vacuum holes obtained during manufacture. In the exemplary container illustrated herein, the height of the base member 40 may be 2.5 inches and the depth of the pocket 51 provided by recessed top wall 50 may be approximately one inch.

FIG. 1 shows that when cover member 20 is fully engaged with base member 40, trapezoidal panel portion 36 of cover member 20 is brought into position next to bottom portion of triangular facet 46 of base member 40. Rim 12 of cover member 20 is positioned next to rim 41 of base member 40. As a result, outward facing surface of rim 41 of base member is disposed against inward facing surface of rim 12 of cover member when container 10 is fully engaged. Cover member 20 is held in position on the base member 40 by reinforcement means, shown in more detail in FIG. 13, which shows in cross section part of the upper rim 12 of cover member 20, including the area of lip 13 of cover member 20 engaging the upper rim 41 of base member 40 at bead 15.

FIGS. 8-11 show bead 15 of base member 40 extends from one side of the lower edge 57 of triangular facet 46 to the other side and projects outwardly from the upper rim 41. As seen in FIGS. 3-6, lip 13 of cover member 20 extends from one side of the lower edge 37 of trapezoidal panel portion 34 to the other side and projects outwardly from the upper rim 12 of cover member 20. As lip 13 of cover member 20 approaches bead 15 of base member 40 lip 13 is adapted to snap over the outward facing surface of bead 15 of base member 40, performing a reinforcement function to secure cover member 20 to base member 40. This snapping function does not occur along the outward edge 48 of pocket 42 in the base member 40. As a result, the outward facing surface of panel 1 of rim 41 below pocket 42 is smoother than the outward facing surface of panel 2, thereby providing a pleasing appearance.

The stacking feature of the invention may be understood more clearly from FIGS. 7, 12 and 14. FIG. 7 shows two containers 10 in cross-section stacked to provide ten cigarette pack pockets in close adjacent relation. Platform 22 is dimensioned so that it is inserted into the underside of base member 40. When cover member 20 reaches the fully inserted position beneath base member 40, underside surface 70 of bottom wall 45 of pocket 42 contacts and rests on pocket ceiling panel 30 of cover member 20. Moreover, the insertion of platform 22 into the underside of base 40 prevents any lateral movement between the two containers. It should be noted that the cooperation between the base member of the top container and the cover member of the bottom container of the vertically stacked containers will facilitate removal of the top container such that there will be little disruption of the remaining stack. Furthermore, as seen in FIG. 7, rims 12 and 41 of the upper cover member 20 and base member 40, respectively, overlap the pocket ceiling panel 30 of the lower cover member 20, thereby shielding from the customer's vision any space gaps in pocket 24 as a result of height differences among cigarette packs inserted into pockets 42.

Base member 40 and cover member 20 are formed by thermal form molding and the walls are integral and may be approximately 0.030 inch thick. Preferably, the material of the container is impervious and presents a rigid surface. Suitable materials for the container are polyethylene terephthalate-G and polyvinyl chloride. A particularly preferred material is polyethylene terephthalate. In thermal form molding of the base member and the cover member, the raw material in the form of a film is heated to softening point and forced against a three dimensional mold by vacuum or pressure. After the material is cooled it is removed from the mold.

The thickness of the wall section of the base member 40 and cover member 20 is uniform throughout the container. The use of a plastic material provides the opportunity for selecting materials for the cover member 20 that are clear for maximum visibility of the cigarette packs.

One skilled in the art will recognize that the present invention can be practiced by other than the embodiments described, which are presented for the purpose of illustration rather than limitation, and the present invention is limited only by the claims which follow.

What is claimed is:

1. A cigarette pack display container comprising:

(a) a hollow cover member generally polygonal in cross section and having a closed end and an open end, said open end defining a rim, the walls of said cover being tapered outwardly from said closed end to said rim, said walls of said cover member being defined by a plurality of spaced outwardly extending pockets adapted to receive cigarette packs and by corner wall panels disposed between respective pockets, said cover member having a platform portion disposed between said closed end and the top of said pockets and forming a top closure for each pocket; and (b) a base member having a bottom rim flange, a generally vertically extending contact wall projecting upwardly from said rim flange and having a shape adapted to receive and to hold releasably said rim of said cover when the cover is placed on said base, said base having a generally polygonal cross section adapted to mate with said cover and having spaced pockets located to cooperate with respective ones of said cover pockets to define therebetween cigarette pack holding elements, and spaced triangular facets disposed between respective ones of said base pockets and being adapted to receive respective ones of said corner panels.

2. The display container of claim 1 wherein said triangular facet of said base member comprises a plurality of substantially parallel grooves extending laterally between the sides of said triangular facet to provide structural strength.

3. The display container of claim 1 wherein said rim of the cover member comprises a panel below said pockets and a panel below said corner wall panel, said panels abutting each other in end-to-end relation, and said rim of said base member comprises a panel below said pockets and a panel below said triangular facets, said panels abutting each other in end-to-end relation.

4. The display container of claim 1 wherein said base member further comprises a recessed top wall to form a well to receive complementary articles.

5. The display container of claim 4 wherein the recessed top wall further comprises a substantially polygonal ring.

6. The cover member rim and base member rim of claim 3 wherein said panel below said corner wall panel has an upper edge comprising a convex configuration adapted to mate with respective ones of said panel below said triangular facet to reinforce engagement between said cover member and base member.

7. A display comprising a vertical stack of the container of claim 1 wherein the top container of said vertical stack comprises a shielding means for blocking from view in said outwardly extending pockets any space gaps resulting from cigarette packs having different heights.

8. The display of claim 7 wherein said shielding means comprises rim of top container base member overlapping said outwardly extending pocket of bottom container cover member.

9. The display container of claim I wherein the height of said platform enables said container to be guided during insertion underneath the base of another container in a vertical stack, said platform also preventing slippage between said containers.

10. The display container of claim 1 wherein said cover member further comprises a slightly recessed top wall to receive display labels.

* * * * *